US009227098B2

(12) United States Patent
Van Der Jagt

(10) Patent No.: US 9,227,098 B2
(45) Date of Patent: Jan. 5, 2016

(54) FIRE-EXTINGUISHING COMPOSITION

(75) Inventor: Hans Van Der Jagt, Ridderkerk (NL)

(73) Assignee: AF-X SYSTEMS B.V., Wijdewormer (NL)

( * ) Notice: Subject to any disclaimer, the term of this patent is extended or adjusted under 35 U.S.C. 154(b) by 169 days.

(21) Appl. No.: 13/985,655

(22) PCT Filed: Feb. 14, 2012

(86) PCT No.: PCT/NL2012/050079

§ 371 (c)(1),
(2), (4) Date: Oct. 21, 2013

(87) PCT Pub. No.: WO2012/112037

PCT Pub. Date: Aug. 23, 2012

(65) Prior Publication Data

US 2014/0041882 A1 Feb. 13, 2014

(30) Foreign Application Priority Data

Feb. 17, 2011 (NL) ..... 2006236

(51) Int. Cl.
*A62D 1/06* (2006.01)
*A62D 1/02* (2006.01)
*A62C 5/00* (2006.01)

(52) U.S. Cl.
CPC .. *A62D 1/06* (2013.01); *A62C 5/006* (2013.01)

(58) Field of Classification Search
CPC ..... A62D 1/06; A62D 1/02
USPC ..... 252/5
See application file for complete search history.

(56) References Cited

U.S. PATENT DOCUMENTS 5,423,385 A * 6/1995 Baratov et al. ..... 169/46
5,425,426 A * 6/1995 Baratov et al. ..... 169/46
5,441,114 A * 8/1995 Spector et al. ..... 169/14
5,831,209 A 11/1998 Kozyrev et al.
5,865,257 A 2/1999 Kozyrev et al.
6,042,664 A 3/2000 Kozyrev et al.
6,116,348 A 9/2000 Drakin
6,264,772 B1 * 7/2001 Drakin ..... 149/19.92
6,689,285 B2 * 2/2004 Rusin et al. ..... 252/3
7,832,493 B2 11/2010 Gross et al.
2012/0034482 A1 * 2/2012 Zeliff et al. ..... 428/532
2014/0357744 A1 * 12/2014 Lauri et al. ..... 521/80

FOREIGN PATENT DOCUMENTS

EP 0925808 A4 6/1999
WO 93/15793 8/1993
WO 94/23800 10/1994
WO WO 2012034493 A1 * 3/2012
WO WO 2012112037 A1 * 8/2012

OTHER PUBLICATIONS

Database WPI, Week 199324, Thomson Scientific, London, GB; AN 1993-194946, XP002677365.

Database WPI, Week 200063, Thomson Scientific, London, GB; AN 2000-654553, XP002677364.

Korostelev, V.G., Combustion, Explosion, and Shock Waves, 41(3):315-318 (2005). "Aerosol-generating pyrotechnic compositions with components interacting in the combustion wave."

* cited by examiner

*Primary Examiner* — Douglas M C Ginty

(74) *Attorney, Agent, or Firm* — Nixon Peabody LLP

(57) ABSTRACT

The invention is directed to a fire-extinguishing composition comprising an oxidant, a secondary fuel and a phenol-formaldehyde resin, wherein the phenolformaldehyde resin molecule contains more than 3 aromatic ring structures and its use to extinguish a fire, especially a fire in an enclosed space. The invention is also directed to a process to prepare such a composition and to the use of the composition to extinguish a fire by an aerosol which is formed during burning of the composition.

12 Claims, No Drawings

FIRE-EXTINGUISHING COMPOSITION

CROSS REFERENCE TO RELATED APPLICATIONS

This application is a 35 U.S.C. §371 National Phase Entry Application of International Application No. PCT/NL2012/050079 filed Feb. 14, 2012, which designates the United States, and which claims benefit of Netherlands Application No. 2006236 filed Feb. 17, 2011, the contents of each of which are incorporated herein by reference in their entireties.

The invention is directed to a fire-extinguishing composition comprising an oxidant, a secondary fuel and a phenol-formaldehyde resin. The invention is also directed to the use of such a composition to extinguish a fire by an aerosol which is formed during burning of said composition.

Such a fire-extinguishing composition is known from U.S. Pat. No. 7,832,493. This patent publication describes a aerosol forming fire-extinguishing composition which composition includes between 67-72 wt % of potassium nitrate, between 8-12 wt % phenol formaldehyde resin and dicyandiamide as the balance.

The efficiency of an aerosol forming fire-extinguishing composition is a combination of a number of factors of which a non-limiting list is provided below. (1) a high fire-extinguishing efficiency at a minimum fire-extinguishing concentration, (2) a low toxicity of the burning products of said composition because they may comprise CO, $NH_3$, $NO_2$ and/or HCN and (3) a low burning temperature of said composition when it is discharged.

A problem of the known fire-extinguishing composition of US-B-7832493 is that the level of toxicity is too high for use as a fire-extinguishing composition in an enclosed space.

The object of the present invention is to provide a fire-extinguishing composition which can be used to extinguish a fire by an aerosol which is formed during burning of said composition wherein the level of toxic gasses like CO, $NH_3$, $NO_2$ and/or HCN is reduced.

This object is achieved by the following composition. Fire-extinguishing composition comprising an oxidant, a secondary fuel and a phenolformaldehyde resin, wherein the phenolformaldehyde resin molecule contains more than 3 aromatic ring structures.

Applicants found that the level of toxic gasses is reduced when using such a composition. This is advantageous because it allows one to use the composition as a fire-extinguishing composition in an enclosed space. Without wanting to be bound the following theory applicants believe that the level of toxic gasses is reduced because of the almost complete conversion or burning of the composition. A partial conversion is found to result in the formation of undesirable by-products such as the aforementioned CO, $NH_3$, $NO_2$ and/or HCN.

The phenol formaldehyde resin may be any resin which is the product of phenol and formaldehyde. The specific phenol formaldehyde resin used in the composition according to the invention is also referred to as a so-called enriched phenol formaldehyde resin. The phenol formaldehyde resin molecule preferably contains 3 to 12 aromatic ring structures and even more preferably 3 to 12 epoxylated phenolic ring structures. The number of aromatic ring structures per molecule is the weight average number of the total of phenol formaldehyde molecules present in the composition as measured according to $^{13}$C-NMR spectroscopy. Preferably an epoxylated phenol-formaldehyde molecule is used, more preferably epoxylated phenol-formaldehyde which is a solid at ambient conditions. The average phenol formaldehyde resin molecule is suitably according to the following formula (1):

(1)

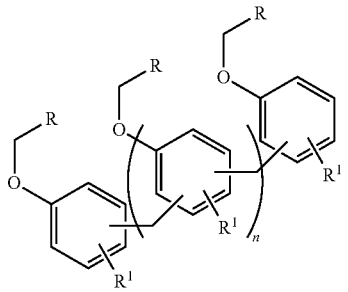

Wherein n is 1 to and including 4 and wherein R is H or wherein —O—$CH_2$—R is a glycidylether group and $R^1$ is hydrogen and/or an organic group.

Preferably R is such that the —O—$CH_2$—R group is a glycidylether group as in the following formula and $R^1$ is hydrogen and/or an organic group:

(2)

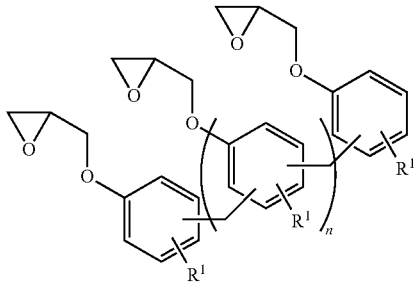

The compounds according to formula (2), wherein $R^1$ is hydrogen, are referred to as poly[(phenyl glycidyl ether)-co-formaldehyde] having a CAS number of 28064-14-4. Examples of commercially available resins having such epoxy groups are the D.E.N. 425, wherein n is 2,5 and the D.E.N. 438, wherein n is 3,8 as obtainable from The DOW Chemical Company and the poly[(phenyl glycidyl ether)-co-formaldehyde] having an molecular weight Mn of about 570 as obtainable from Sigma-Aldrich as product number 406767. Other examples of suitable epoxylated phenol formaldehyde resins are so-called Novolac resins as obtained by an initial reaction of phenol and formaldehyde.

In case at least one group $R^1$ is an organic group it may be any organic group. Preferred organic groups $R^1$ may comprise a further epoxylated phenolic group. An example of such a structure is shown in FIG. 1. Formula (3) shows an example of a phenol formaldehyde resin molecule wherein R is such that the —O—$CH_2$—R group is a glycidylether group and $R^1$ comprises a further epoxylated phenolic group. The aromatic rings of group $R^1$ are to be included in calculating the total of aromatic rings in the compound according to the invention. Such compounds are based on bisphenol A. The compound according Formula (3) can be obtained from Momentive as EPON™ Resin SU-8 having 8 aromatic rings.

(3)

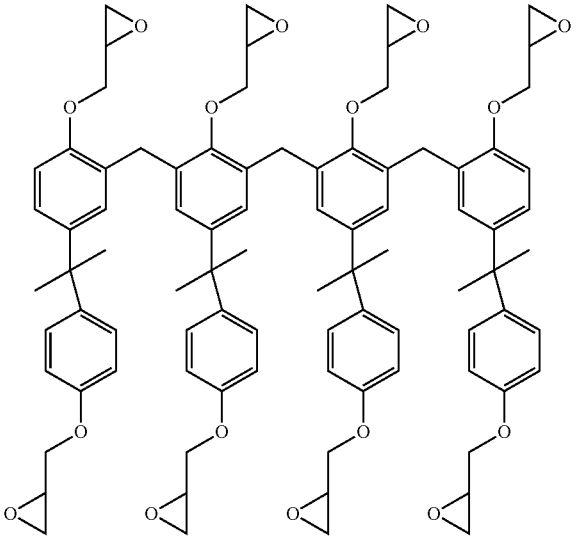

The phenolformaldehyde resin may be present in a solution of for example ethyl alcohol and/or acetone. More preferably the phenolformaldehyde resin is a solid at ambient conditions and mixed as a solid with the other components when preparing the composition. This is advantageous because solvents are difficult to remove from the composition when preparing the composition. Applicants found that when starting with a solid phenolformaldehyde resin a more uniformed mixed composition results and a lengthy drying step is avoided for removing the solvent. Preferably the particle size of the oxidant used to prepare the composition is such that more than 90 wt % of the particles have a size of between 50 and 150 μm and more preferably have a size of between 70 and 120 μm as measured by ISO 13320:2009.The oxidant may be perchlorate or more preferably a nitrate of an alkali metal. Halogenated compounds are preferably not present in the composition in order to avoid toxic gasses when the composition is used to extinguish a fire. The alkali metal may be sodium or potassium and more preferably potassium. A most preferred alkali nitrate is $KNO_3$ because of its readily availability. Preferably the particle size of the oxidant used to prepare the composition is such that more than 90 wt % of the particles have a size of between 10 and 30 μm and more preferably have a size of between 15 and 25 μm as measured by ISO 13320: 2009. Preferably part of the oxidant is present as particles with an even smaller size, suitably wherein more than 90 wt % of the particles has a size of between 1 and 7 Suitably the part of the oxidant particles having such a smaller size is between 30 and 70 wt % of the total of oxidant. Thus preferably between 30 and 70 wt % of the total of oxidant particles is present as particles with a size of between 1 and 7 μm.

Applicant found that it is preferred to choose the ratio of oxidant and phenol formaldehyde resin within well defined ranges as expressed in the molar ratio of the alkali metal atoms as present in the oxidant and the carbon atoms as present in the total of phenolformaldehyde resin. A too low ratio amount of oxidant relative to the resin may result in formation of a high toxicity of the burning products and a too high ratio of oxidant relative to the resin may result in a lower fire-extinguishing efficiency and a high toxicity of the burning products. Suitably the molar ratio between the alkali metal atoms as present in the oxidant and the carbon atoms as present in the total of phenolformaldehyde resin in said composition is between 0.8:1 and 1:0.8.

It has been found that by using the phenolformaldehyde resin according to the present invention a lower content of said resin can be used and a higher content of oxidant. This is advantageous because it is found to result in a higher formation of potassium hydrocarbonate and potassium carbonate, in case a potassium based oxidant is used, in the burning products of the composition when used. The presence of these compounds higher is advantageous to achieve a high fire-extinguishing efficiency.

The secondary fuel is preferably a low-carbon polynitrogen, a carbon free polynitrogen, an organic azide and/or an inorganic azide. Such compounds are suitably represented by the general formula's $C_xN_yH_z$ or $C_xN_yH_zA_w$, wherein x, y, z and w are integers and wherein y>x, x may be zero and A is a metal atom as for example alkali metals Li, Na, K, Rb, Cs and Fr. Examples are azodicarbonate, guanidine, dicyanodiamide, melem, melamine, urea, urotropin, azobisformamide, semicarbazide, dihydroglyoxime, tetrazole, ditetrazole, and their derivatives, or their salts or blends. Suitable secondary fuels are melem, melamine and dicyamodiamide (DCDA) .The content of the secondary fuel in said composition is preferably between 10 and 22 wt. Preferably the particle size of the secondary fuel used to prepare the composition is such that more than 90 wt % of the particles have a size of between 40 and 80 μm as measured by ISO 13320:2009.

Suitably the composition also comprises one or more additives. Examples of suitable additives are aluminium and magnesium compounds, individually or their blends or alloys with other metals. Other additives which may be present in combination with the aforementioned aluminium or magnesium based additives are the oxides of copper, iron, zinc, manganese or chromium. A preferred additive is magnesium hydroxide. The content of the total of additives in the composition according to the invention is suitably between 0.5 and 5 wt %.

The fire-extinguishing composition according to the invention is suitably prepared by mixing the different components in for example a blade mixer and subsequently pressing the mixed phase into the desired shape. Possible shapes are cylindrical, e.g. tablets. Suitably the composition is prepared by (i) mixing the oxidant fraction having the larger particle sizes with the phenolformaldehyde resin to obtain a first mixture and mixing said first mixture, (ii) adding the secondary fuel to the first mixture and mixing said resulting second mixture, (iii) adding a second fraction of the oxidant having the smaller particle size and mixing said resulting third mixture, (iv) adding the phenol formaldehyde resin having a smaller particle size as in step (i) and mixing said resulting fourth mixture, (v) adding a next fraction of the secondary fuel having a smaller particle size than in step (ii) and mixing said fifth mixture to obtain the final composition. This final composition is subsequently pressed into a desired shape, such as a tablet, a cylinder or a block. Suitably the above components are mixed as solids. This is advantageous because the preparation can thus avoid the need for a drying step and the use of light flammable and/or explosive solvents. In case a magnesium hydroxide additive is used it is preferred to first mix the additive with both of the above referred to oxidant fractions before adding said oxidant fraction.

The fire-extinguishing composition according to the invention is suitably used to extinguish a fire and more suitably in cases where in the fire is present in an enclosed space. Applicants found that the efficiency of the aerosol to extinguish a fire is more efficient than a state of the art aerosol. Applicants further found that although the initial temperature at which the aerosol is formed is high, the temperature quickly reduces in time. This is advantageous because the use of this composition will then require less cooling of the formed aerosol before it is discharged into the space wherein the fire is present. Prior art aerosol fire extinguishing compositions require additional cooling means such as illustrated in U.S. Pat. No. 6,116,348. The cooling means of U.S. Pat. No. 6,116,348 consisted of cylinders filled with $K_2CO_3$ coated zeolite. In use the fire extinguishing composition and cooling means are present in a casing. The use of such cooling means introduce complexity to the design of the casing. Applicants now found that because the temperature at which the aerosol is formed is lower such additional cooling means are not required. Instead a minor level of cooling is required which can be achieved by using water as illustrated in W093/15793 or more preferably by mixing the aerosol with air before discharging the aerosol into the space wherein the fire is present. Preferably this additional air is drawn from the environment to the aerosol mixture by means of a venture effect.

The composition is suitably present in an apparatus for fire extinguishing comprising a casing having a discharge port at a downstream end thereof and a combustion chamber accommodated in said casing, the combustion chamber containing the fire-extinguishing composition according to the invention and ignition means for ignition of said composition, wherein the casing has one or more openings fluidly connecting the exterior of the casing and a cooling space between the fire-extinguishing composition and the open downstream end. These openings will allow air to be sucked into this cooling space resulting in a sufficient cooling of the aerosol. The sucking of air is achieved by the so-called venture effect. In this manner the flow of aerosol discharging through the cooling space to the discharge port sucks in air from outside the casing. Examples of a suitable design for such a casing is shown in FIG. 2 of WO93/15793.

An example illustrating the preparation is described below.

EXAMPLE 1

For the preparation of 1 kg of the composition a blade mixer is charge with 73 grams of phenol formaldehyde glycidylether polymer resin (CAS number 28064-14-4) fraction with a particle size of 70-120 μm having the following properties:

| | |
|---|---|
| Activity | 3.8 epoxide groups per molecule |
| mol wt | average Mn ~605 |
| transition temp | softening point 48-58° C. |
| Density | 1.227 g/mL at 25° C. (lit.) |

Under stirring 176 grams of a potassium nitrate (CAS number 7757-79-1) fraction having a particle size of 15-25 μm is added, to the surface of which 1.5 grams of magnesium hydroxide (CAS number 7439-95-4) has been previously applied. The application of the Mg powder to the surface of the oxidizing agent is carried out by mixing the components in a blade mixer and subsequently passing the surface modified oxidizing agent twice through a metal sieve with a mesh of 40 μm. Subsequently 145.6 grams of a dicyandiamide (CAS number 461-58-5) fraction with a particle size of 40-80 μm is added. The resulting mixture is stirred for 5 minutes. Next 526 grams of a potassium nitrate fraction having a particle size of 1-7 μm is added. To the surface of the particles of the potassium nitrate fraction magnesium hydroxide is applied in an amount of 10.5 grams. The application of the magnesium hydroxide to the potassium nitrate surface is carried out in a blade mixer by adding the magnesium hydroxide to the potassium nitrate under stirring, which is accomplished within one hour. Next 31 grams of the phenol formaldehyde glycidylether as used above but with a particle size of 10-25 μm is added under stirring to the obtained powdery mass. Next 36 grams of dicyandiamide fraction with a particle size of 7-15 μm is added and the resulting mixture is stirred for 15 minutes. The final composition is a powdery material of white colour. The composition is subsequently moulded by blind pressing at a specific pressure of 1200 kgf/cm2 (120 MPa) into a tablet. The tablet has approximately the following composition:

| | |
|---|---|
| Epoxy resin: | 10.4 mass % |
| Potassium nitrate | 70.2 mass % |
| Dicyandiamide (DCDA) | 18.2 mass % |
| Magnesium hydroxide powder $Mg(OH)_2$ | 1.2 mass % |

EXAMPLE 2

Example 1 was repeated except that the compound according to FIG. 1 was used instead of the phenol formaldehyde glycidylether polymer resin of Example 1. The compound was obtained from Momentive as EPON™ Resin SU-8 and had the following particle size of 10 -25 μm.

| | |
|---|---|
| Epoxy resin: | 10.2 mass % |
| Potassium nitrate | 71.2 mass % |
| Dicyandiamide (DCDA) | 16.1 mass % |
| Magnesium hydroxide powder $Mg(OH)_2$ | 2.0 mass % |
| Silica mixing additives | 0.5 mass % |

EXAMPLE 3

A stainless steel container was filed with 40 grams of the composition as prepared in Example 2. The container did not contain elements for cooling the formed aerosol. The fire-extinguishing composition was activated by electrical ignition at 300° C. in a metallic combustion chamber provided at one side with a glass wall. The conditions at activation was: temperature was 14° C., the relative humidity (RH) of 87% and air pressure of 1017 hPa. The measured temperature at ignition was 1100° C. This high temperature is advantageous to avoid generation of not fully oxidated compounds such as CO, NO, HCN and $NH_3$. To confirm this, an expert, who assessed the smoke by odour assessments during the discharges, did not notice any traces of HCN and $NH_3$.

In time the temperature quickly decreased from 1100° C. due to the presence of high quantities of $KHCO_3$ and $K_2CO_3.1.5H_2O$ having a very small particle size of about 1 to 2 micron. Thus a lower exit temperature was observed as the aerosol exited the container. The aerosol as formed was a dense white cloud which was visibly present within the combustion chamber for up to an hour. The white cloud became less dense in time which is advantageous because it enhances the visibility.

| Compound | Weight percentage |
|---|---|
| $KHCO_3$ | 36.4 |
| $K_2CO_3 \bullet 1.5H_2O$ | 26.8 |

-continued

| Compound | Weight percentage |
|---|---|
| $KNO_2$ | 0.98 |
| $KNO_3$ | 0.01 |
| $NH_4HCO_3$ | 0.54 |
| KCl | 0.44 |
| $K_2SO_4$ | 0.02 |
| KOH | 2.71 |
| HCN | 0.09 |
| $C_2H_4N_4$ | 2.71 |
| $H_2O$ | 19.2 |
| S elementary | 0.05 |
| Carbon | 8.4 |

From the container 30.4 grams of compounds were discharged into the combustion chamber. This means that 87 wt % of the original composition is discharged which indicated a high efficiency. The main components of the composition of the aerosol were determined and as presented in the above Table: The residual particles were dissolved in water and the Ph was found to be 10.1.

EXAMPLE 4

A fire fuelled by hexane was extinguished using the composition of example 2. A quick and efficient extinguishing of the fire was observed. When a lower quantity was used a longer period of time was required to achieve full extinguishing of the fire.

The invention claimed is:

1. A fire-extinguishing composition comprising an oxidant, a secondary fuel and a phenolformaldehyde resin, wherein the phenolformaldehyde resin molecule contains up to 12 aromatic ring structures as represented by the following formula:

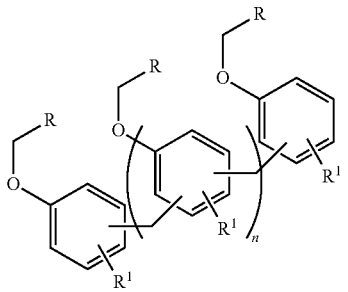

and wherein the n is 1 to and including 4; and wherein —O—$CH_2$—R is a glycidylether group and $R^1$ is hydrogen and/or an organic group; and wherein at least one group $R^1$ comprises an epoxylated phenolic group.

2. The composition according to claim 1, wherein the oxidant is a nitrate of an alkali metal.

3. The composition according to claim 2, wherein the alkali metal is sodium or potassium.

4. The composition according to claim 1, wherein the content of oxidant in said composition is greater than 65 wt %.

5. The composition according to claim 4, wherein the content of oxidant in said composition is between 65 and 75 wt %.

6. The composition according to claim 5, wherein the molar ratio between the alkali metal atoms as present in the oxidant and the carbon atoms as present in the total of phenolformaldehyde resin in said composition is between 0.8:1 and 1:0.8.

7. The composition according to claim 1, wherein the secondary fuel is selected from; a low-carbon polynitrogen, a carbon free polynitrogen, an organic azide or an inorganic azide having the general chemical formula $C_xN_yH_z$ or $C_xN_yH_zA_w$, wherein y>x, x may be zero, A is a metal atom.

8. The composition according to claim 7, wherein the secondary fuel is melamine, melem or dicyandiamide.

9. The composition according to claim 1, wherein the content of the secondary fuel in said composition is between 10 and 22 wt %.

10. A process to prepare a fire extinguishing composition by (i) mixing a solid oxidant fraction having a larger particle sizes with a solid phenolformaldehyde resin to obtain a first mixture and mixing said first mixture, (ii) adding a solid secondary fuel to the first mixture and mixing said resulting second mixture, (iii) adding a second fraction of a solid oxidant having a smaller particle size and mixing said resulting third mixture, (iv) adding the solid phenol formaldehyde resin having a smaller particle size as in step (i) and mixing said resulting fourth mixture, (v) adding a next fraction of the solid secondary fuel having a smaller particle size than in step (ii) and mixing said fifth mixture to obtain the final composition, wherein the phenolformaldehyde resin molecule contains up to 12 aromatic ring structures wherein the resin is represented by the following formula:

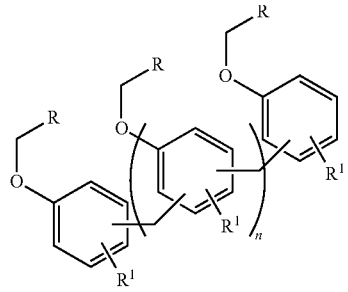

and wherein the n is 1 to and including 4, wherein

—O—$CH_2$—R is a glycidylether group and $R^1$ is hydrogen and/or an organic group, wherein at least one group $R^1$ comprises an epoxylated phenolic group and wherein the-above components are mixed as solids.

11. The process according to claim 10, wherein between 30 and 70 wt % of the total of oxidant particles is present as particles with a size of between 1 and 7 μm.

12. An apparatus comprising a casing having a discharge port at a downstream end thereof and a combustion chamber accommodated in said casing, the combustion chamber containing the fire-extinguishing composition according to any one of claims 1-5 or obtainable by a process according to claim 10 or 11 and an ignition means for ignition of said composition, wherein the casing has one or more openings fluidly connecting the exterior of the casing and a cooling space between the fire-extinguishing composition and the open downstream end.

* * * * *